US005165142A

United States Patent [19]

Pilsbury

[11] Patent Number: 5,165,142

[45] Date of Patent: Nov. 24, 1992

[54] RUNNER GUIDE FOR A SLIDING ELEVATOR DOOR

[75] Inventor: Richard H. Pilsbury, Lake Hiawatha, N.J.

[73] Assignee: Inventio AG, Hergiswil, Switzerland

[21] Appl. No.: 869,881

[22] Filed: Mar. 12, 1992

Related U.S. Application Data

[63] Continuation of Ser. No. 592,600, Oct. 4, 1990, abandoned.

[51] Int. Cl.[5] ..... E05D 15/06; B66B 13/00

[52] U.S. Cl. ..... 16/90; 16/91; 49/226; 49/409; 160/196.1; 187/56

[58] Field of Search ..... 16/90, 91, 99, 100; 49/234, 235, 409, 410, 226; 160/196.1; 187/56-58

[56] References Cited

U.S. PATENT DOCUMENTS

| | | | |
|---|---|---|---|
| 2,611,920 | 9/1952 | Borden . | |
| 3,509,665 | 5/1970 | Bartlett et al. | 16/91 |
| 3,611,637 | 10/1971 | Saino | 16/90 |
| 4,593,793 | 6/1986 | Salmon . | |
| 4,619,075 | 10/1986 | Wiles | 49/410 |
| 4,639,970 | 2/1987 | Adams . | |

FOREIGN PATENT DOCUMENTS

| | | |
|---|---|---|
| 0343351 | 11/1989 | European Pat. Off. . |
| 1559829 | 1/1972 | Fed. Rep. of Germany . |
| 2428593 | 10/1975 | Fed. Rep. of Germany . |
| 89138155 | 2/1990 | Fed. Rep. of Germany . |
| 535552 | 4/1941 | United Kingdom . |

*Primary Examiner*—Lowell A. Larson
*Assistant Examiner*—Thomas C. Schoeffler
*Attorney, Agent, or Firm*—William J. Clemens

[57] ABSTRACT

A runner guide for an elevator door includes a ramp member at an end of travel position along a guide rail for engaging a roller attached to the door and running on the guide rail. The roller has a rim disc which engages a surface on the ramp member to move an insert in the roller out of engagement with the rail thereby relieving the load on and preventing flattening of the running surface on the insert when the door is at rest. The insert is formed of a non-metallic and hard elastic material to reduce running noise. The door is supported by a pair of such rollers, each having a pair of rim discs, and one roller is asymmetric with one of the rim discs being of a smaller diameter to move past the ramp member associated with the other roller without contact during opening and closing of the door.

7 Claims, 2 Drawing Sheets

RUNNER GUIDE FOR A SLIDING ELEVATOR DOOR

This application is a continuation of application Ser. No. 592,600, filed Oct. 4, 1990, now abandoned.

BACKGROUND OF THE INVENTION

The present invention generally concerns sliding elevator doors and, in particular, a runner guide for quiet operation of such a door.

It is known that sliding door runners having rollers with metallic running surfaces traveling on metallic guide rails cause disturbing noises. For this reason, different kinds of non-metallic running surfaces for runners were created, which surfaces help to reduce the running noises. The softer the nature of the running surface, the less running noise is generated. On the other hand, the rolling resistance increases for softer materials, which resistance can, however, be compensated for by correspondingly increased door driving power.

The phenomenon of the running surface flattening at standstill has an appreciably worse effect, because a bump motion with corresponding cluttering noises is the consequence thereof. The flat spots are created when a loaded roller remains standing in the same position for a long time. This operation applies particularly to the automatic sliding elevator door, since these doors must regularly remain in the closed position for several hours.

A good solution which does not have the above identified disadvantages and nevertheless promises quiet is described in the U.S. Pat. No. 2,611.920. The roller has a vibration-damping intermediate layer positioned between an outer ball bearing ring and a roller body, and the roller guide rail likewise displays such a layer between its foot portion and an upper portion. A flattening of the running surface cannot take place, but the running operation is not as quiet as desired. In spite of the vibration-damping intermediate layers in the roller and in the guide rail, a metal-on-metal rolling friction always is present. Moreover, the construction is very expensive, whereby the additional costs tend not to be justifiable for this application.

SUMMARY OF THE INVENTION

The present invention is based on the task of creating an elevator door runner guide having a guide rail and a roller, which runner guide does not display the above identified disadvantages, which can be simply and inexpensively manufactured, and which can be fitted to existing automatic sliding elevator doors. The runner guide for a sliding elevator door, according to the present invention, includes a generally longitudinally extending guide rail mounted above a door opening and a pair of rollers attached to the upper edge of an elevator door. Each roller includes a non-metallic and relatively hard elastic material running surface insert and the guide rail has a cross-sectional shape adapted to engage the insert and guide the roller for movement along the guide rail. At the closed door end position of a path of travel for the rollers, a ramp member is attached to the guide rail for engaging the associated roller and moving the running surface insert out of engagement with the guide rail thereby relieving the roller of the door load.

An elevator door panel typically is suspended from the guide rail by a pair of such rollers. However, the roller at the leading edge of the door panel is asymmetric having one rim disc of a smaller diameter and another rim disc of a larger diameter extending downwardly on opposite sides of the guide rail. Thus, as the asymmetric roller is moved along the guide rail, the smaller diameter rim disc moves over the ramp member for the other roller without contact while the larger diameter rim disc engages its associated ramp member at the end of travel to move the running surface insert out of engagement with the guide rail.

The advantages achieved by the present invention are that a solution to the runner guide noise problem is obtained through an adapted shaping of a standard machine part, the guide rail and by a few additional simple components for the rollers, and that the operation of the runner guide for an elevator door achieves hitherto not known low noise values. The present invention combines all the advantages of an elastic roller running surface without, however, the disadvantages of flattening of the running surface under load during longer duration standstills.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
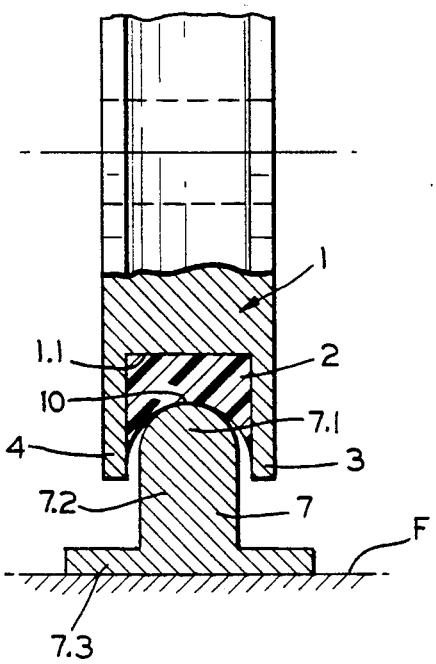
FIG. 1 is a side elevation view in cross section of a sliding elevator door runner guide with a roller in an intermediate position on a guide rail in accordance with the present invention.

In the FIG. 1, a roller body is denoted generally by 1 and is partially cut away to expose an annular groove 1.1 formed in a periphery thereof. An elastic material insert 2, having a half-round running surface 10 facing the groove opening, is retained between two generally parallel, rigid rim discs 3 and 4, which discs protrude along both sides of the running surface 10 to form the sides of the groove 1.1. The discs 3 and 4 are preferably formed of a metal material. The rim discs 3 and 4 can be of the same material as the roller body 1, and can be separate elements or integral components of the same as shown. The running surface 10 is in contact with and runs along a half-round head portion 7.1 of a guide rail 7 to function as a sliding door runner guide. The guide rail 7 has a longitudinally extending widened base portion 7.3 which is supported on and fastened to an upwardly facing frame surface F above a door opening. Extending upwardly from the base portion 7.3 is a longitudinally extending generally vertical leg 7.2, which is terminated at an upper edge by the half-round head portion 7.1. The roller body 1 is shown in an intermediate position along the guide rail 7 with the rim discs 3 and 4 extending downwardly along the sides of the vertical leg 7.2.

Figure 2:
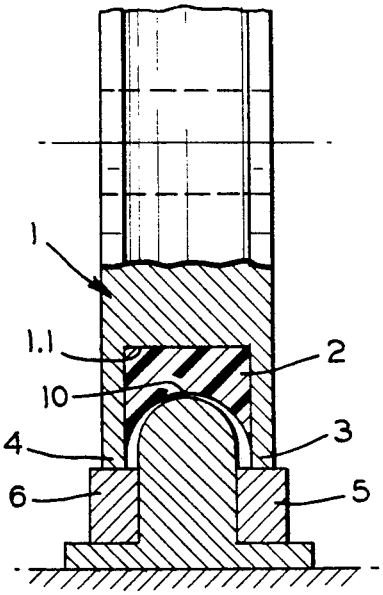
FIG. 2 is side elevation view in cross section of the roller and the guide rail shown in FIG. 1 with the roller in an end position.
Figure 3:
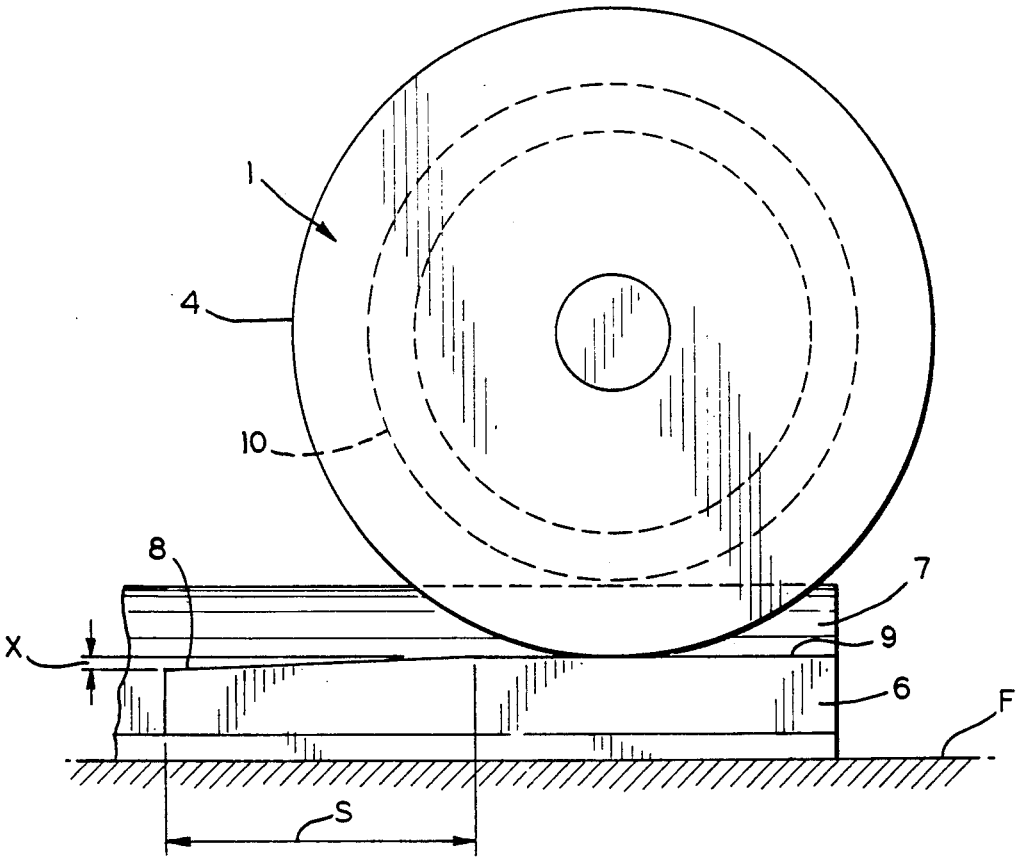
FIG. 3 is a front elevation view of the roller and the guide rail shown in FIG. 2.

In the FIG. 2, the roller body 1 is illustrated in an end position along the guide rail 7. At this position, a pair of ramp members 5 and 6 are mounted on the base portion 7.3 on each side of the vertical leg 7.2. The height of the ramp members 5 and 6 is so dimensioned that the rigid rim discs 3 and 4 respectively engage the upper surfaces which completely relieves the load, for example the weight of an associated elevator door, from the elastic material running surface 10. In the FIG. 3, the same position as shown in the FIG. 2 is illustrated in a front elevation view of the elevator door. The rim disc 4 has run from left to right up a ramp surface 8 onto a generally horizontally extending upper surface 9 of the ramp member 6 and has, in consequence of the dimensions of the rim disc diameter and the ramp member height, relieved the running surface 10 of the roller 1 by lifting off the guide rail 7. The ramp member 5 also has the ramp surface 8 and the upper surface 9. The ramp surface 8 has, for example, a grade ratio of S to X which is approximately equal to ten to one.

Figure 4:
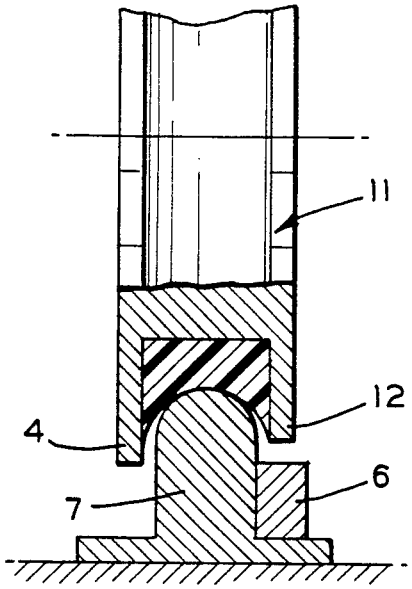
FIG. 4 is a side elevation view in cross section of an alternate embodiment of the roller and the guide rail shown in FIG. 1.
Figure 5:
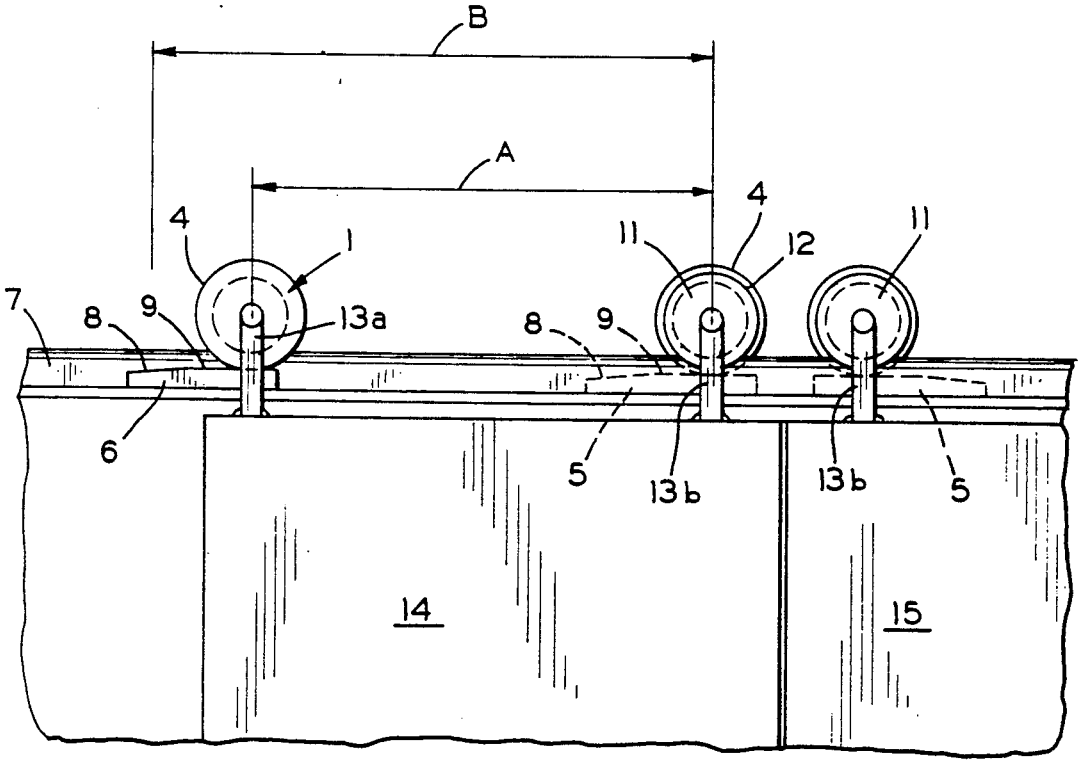
FIG. 5 is a front elevation view of a sliding elevator door incorporating the rollers and the guide rail shown in FIGS. 1 and 4.

In the FIG. 4, an asymmetric roller 11 is illustrated in cross-section and at the right-hand side has a rigid rim disc 12 with a diameter which is smaller than the larger diameter left-hand side rigid rim disc 4. The asymmetric roller 11 can move over the ramp member 6 mounted on the right-hand side of the guide rail 7 without the running surface 10 being lifted off, and thus without the supported load being relieved. Through this measure, it is possible to apply the principle to sliding door leaves or panels, in which the roller spacing is less than the horizontal travel distance of the door. In the FIG. 5, the principle is evident in a front partial elevation of an automatic sliding elevator door. A left-hand door panel 14 is attached by a suspension 13*a* with the roller 1 and by a suspension 13*b* with the asymmetric roller 11. A right-hand door panel 15 is attached in the same manner with the rollers 1 and 11, only the roller 11 being shown. The right-hand asymmetric roller 11 attached to the door panel 14 is installed so that the smaller rim disc 12 is toward the front of the door. Correspondingly, the ramp members 5 and 6, adjacent to and associated with the rollers 11 and 1 respectively, are mounted respectively behind and in front of the vertical leg 7.2 of the guide rail 7 and are spaced apart approximately the same distance as the rollers.

The apparatus described above operates as follows: In the FIG. 5, it is shown that a spacing A between the rollers 1 and 11 associated with the door panel 14 is smaller than a displacement B representing the distance travelled by the roller 11 along the guide rail 7 between the open and closed positions of the door panel 14. Thus, during a closing movement of the elevator door, the asymmetric roller 11 must be able to move from the door open position over the left-hand ramp member 6 without contact. This movement is possible because the smaller diameter rim disc 12 at the front of the right-hand asymmetric roller 11 clears the upper surface of the ramp member 6.

In the illustrated application, the running surfaces 10 of the rollers 1 and 11 are relieved of the door load only in the closed position of the sliding elevator door. Such construction is for the reason that the typical dwell time of an elevator door in the closed position is much longer than the dwell time in the open position. However, if required, it is readily possible to provide a load relief for the running surfaces 10 in both end positions of the door. In that case, the roller 1 is replaced by another one of the asymmetric rollers 11 and the smaller diameter rim discs 12 are positioned on opposite sides of the guide rail 7. Another pair of the ramp members 5 and 6 can be provided for the end positions of the rollers when the door is open. A second ramp member 5 (not shown) can be spaced the distance B to the left of the ramp member 5 shown in FIG. 5 on the rear side of the guide rail 7 with the ramp surfaces 8 facing each other. Similarly, a second ramp member 6 (not shown) can be spaced the distance B to the left of the ramp member 6 shown in the FIG. 5 on the front side of the guide rail 7 with the ramp surfaces 8 facing each other.

When utilizing the present invention, the running of the rim discs onto the ramp members is no longer audible as noise, because the door speed is very small in the region of the end positions of the door panels. Relatively soft material damping inserts 2 can be provided because the rollers no longer remain supported on the running surfaces in the end positions and no flattening can thus arise. The movement of a sliding elevator door is practically noiseless with the apparatus according to the present invention. Typically, the standard elevator guide rail can be shaped and a few additional simple components added to the standard rollers to obtain the runner guide according to the present invention. The present invention lends itself for use in other types of sliding doors, such as, for example, the entry doors in shops and hotels, or for any kind of internal connecting doors in office buildings, residential buildings or hospitals. Likewise, the present invention can be applied to telescopic doors, where the effect of quiet of running is significant, in particular in the case of a rapidly moving door panel.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In a runner guide for a sliding elevator door, the runner guide having a generally longitudinally extending guide rail and a roller, the roller including a non-metallic and relatively hard elastic material running surface insert and the guide rail having a cross-sectional shape providing a running surface portion adapted to engage the insert and guide the roller for rolling movement along the guide rail, the improvement comprising: means attached to the guide rail and positioned adjacent at least one end of a path of travel of the roller for engaging the roller when closing said door and moving the running surface insert out of engagement with the running surface portion of the guide rail whereby relatively low noise levels are generated during rolling movement of the roller with the insert engaged with the guide rail and flattening of the insert is prevented when said door is closed due to movement of the insert out of engagement with the guide rail by said means for engaging and moving.

2. The runner guide according to claim 1 wherein the roller includes a rim disc extending along a side of the guide rail and said means for engaging and moving includes a ramp member attached to the guide rail and having an upper surface for engaging an edge of said rim disc and moving the insert out of engagement with the guide rail.

3. The runner guide according to claim 1 wherein said means for engaging and moving includes at least two ramp members attached to the guide rail and each said ramp member has an horizontal upper surface and a ramp surface for engaging the roller.

4. The runner guide according to claim 1 wherein the roller is asymmetric having one rim disc of a smaller diameter and another rim disc of a larger diameter extending downwardly on opposite sides of the guide rail and whereby when the roller is moved along the guide rail, said smaller diameter rim disc moves over said means for engaging and moving without contact and said larger diameter rim disc engages said means for engaging and moving to move the running surface insert out of engagement with the guide rail.

5. A runner guide for a sliding elevator door comprising: a generally longitudinally extending guide rail and a pair of rollers, each said roller including a non-metallic and relatively hard elastic material running surface insert and said guide rail having a cross-sectional shape providing a running surface portion to engage said inserts and guide said rollers for rolling movement along said guide rail, and means attached to said guide rail and positioned adjacent at least one end of a path of travel of said rollers for engaging said rollers when closing said door and moving said inserts out of engagement with said guide rail running surface portion whereby relatively low noise levels are generated during rolling movement of the roller with the insert engaged with the guide rail and flattening of the insert is prevented when said door is closed due to movement of the insert out of engagement with the guide rail by said means for engaging and moving.

6. A sliding door for closing an opening comprising: a door panel; a generally longitudinally extending guide rail; a pair of rollers attached to said door panel, each said roller including a non-metallic and relatively hard elastic material running surface insert and said guide rail having a cross-sectional shape providing a running surface portion adapted to engage said inserts and guide said rollers for rolling movement along said guide rail; and means attached to said guide rail and positioned adjacent at least one end of a path of travel of said rollers for engaging said rollers when closing said door and moving said inserts out of engagement with said guide rail running surface portion whereby relatively low noise levels are generated during rolling movement of the roller with the insert engaged with the guide rail and flattening of the insert is prevented when said door is closed due to movement of the insert out of engagement with the guide rail by said means for engaging and moving.

7. The sliding door according to claim 6 including another door panel adapted to cooperate with said door panel at a door opening; another pair of rollers attached to said another door panel and each including a non-metallic and relatively hard elastic material running surface insert for movement along said guide rail; and other means attached to said guide rail and positioned at least one end of a path of travel of each of said another pair of rollers for engaging said another pair of rollers and moving associated ones of said inserts out of engagement with said guide rail.

* * * * *